US007517221B2

(12) United States Patent
Chidakel et al.

(10) Patent No.: US 7,517,221 B2
(45) Date of Patent: Apr. 14, 2009

(54) VERTICAL EXTENDER FOR AN ELECTRICAL OUTLET WHICH PROTECTS PETS AND CHILDREN FROM SHOCK HAZARDS

(76) Inventors: David W Chidakel, 6 Colby Rd., Wellesley, MA (US) 02482; William H Groves, Jr., 53 Melrose St., Arlington, MA (US) 02472; Paul A Boduch, 1 Garrett Dr., Northampton, NH (US) 03862; Michael E Beach, 44 Greenville St., Somerville, MA (US) 02143

( * ) Notice: Subject to any disclaimer, the term of this patent is extended or adjusted under 35 U.S.C. 154(b) by 0 days.

(21) Appl. No.: 11/881,468

(22) Filed: Jul. 27, 2007

(65) Prior Publication Data

US 2009/0029597 A1 Jan. 29, 2009

(51) Int. Cl.
*H01R 39/00* (2006.01)

(52) U.S. Cl. ..... 439/32; 439/501

(58) Field of Classification Search ..... 439/64, 439/640, 11, 1, 31, 162, 32, 501
See application file for complete search history.

(56) References Cited

U.S. PATENT DOCUMENTS

| | | | | |
|---|---|---|---|---|
| 3,775,729 | A | 11/1973 | Casper | |
| 3,955,870 | A | 5/1976 | Wasserman | |
| 4,070,078 | A | 1/1978 | Chrones | |
| 4,113,336 | A | 9/1978 | Hon Man | |
| 4,283,102 | A | 8/1981 | Richier | |
| 4,302,624 | A | 11/1981 | Newman | |
| 4,451,101 | A | 5/1984 | Davis | |
| 4,553,798 | A * | 11/1985 | Murphy | 439/32 |
| 4,613,728 | A | 9/1986 | Lathrop | |
| 4,618,740 | A | 10/1986 | Ray et al. | |
| 4,718,856 | A | 1/1988 | Pinkerton | |
| 4,779,816 | A | 10/1988 | Varlet | |
| 4,810,833 | A | 3/1989 | Meyers | |
| 4,846,707 | A | 7/1989 | Pirkle | |
| 4,950,842 | A | 8/1990 | Meninga | |
| 4,952,756 | A | 8/1990 | Meyers | |
| 4,993,963 | A | 2/1991 | Pedigo | |
| 5,085,590 | A | 2/1992 | Galloway | |
| 5,085,591 | A | 2/1992 | Warren, Sr. et al. | |
| 5,102,345 | A | 4/1992 | Stanwick et al. | |
| 5,256,076 | A | 10/1993 | Hamlin | |
| 5,281,156 | A | 1/1994 | Yi | |
| 5,675,126 | A | 10/1997 | Halvorsen | |
| 5,895,275 | A * | 4/1999 | Harbertson | 439/21 |
| 5,961,336 | A | 10/1999 | Finlay | |
| 5,997,319 | A | 12/1999 | Wu | |
| 6,012,941 | A | 1/2000 | Burdenko et al. | |
| 6,031,183 | A | 2/2000 | Guerrieri | |
| 6,642,450 | B1 * | 11/2003 | Hsiao | 174/53 |
| 6,764,322 | B1 * | 7/2004 | Yu | 439/137 |
| 7,004,782 | B2 * | 2/2006 | Kroenung | 439/456 |
| 7,056,145 | B2 | 6/2006 | Campbell, III et al. | |
| 7,070,462 | B2 | 7/2006 | Conn | |
| 7,078,624 | B1 | 7/2006 | Stewart | |
| 2002/0182936 | A1 * | 12/2002 | Fowler | 439/652 |

* cited by examiner

*Primary Examiner*—Neil Abrams
*Assistant Examiner*—Phuong Nguyen

(57) ABSTRACT

An easily added extender for existing electric outlets with at least one electric outlet of its own which can be positioned beyond the reach of children and pets.

4 Claims, 2 Drawing Sheets

Showing Room Side of Device.
A vertical extender for an electrical outlet which protects pets and children from shock hazards FIG 1 Showing Wall Side of Device.
A vertical extender for an electrical outlet which protects pets and children from shock hazards
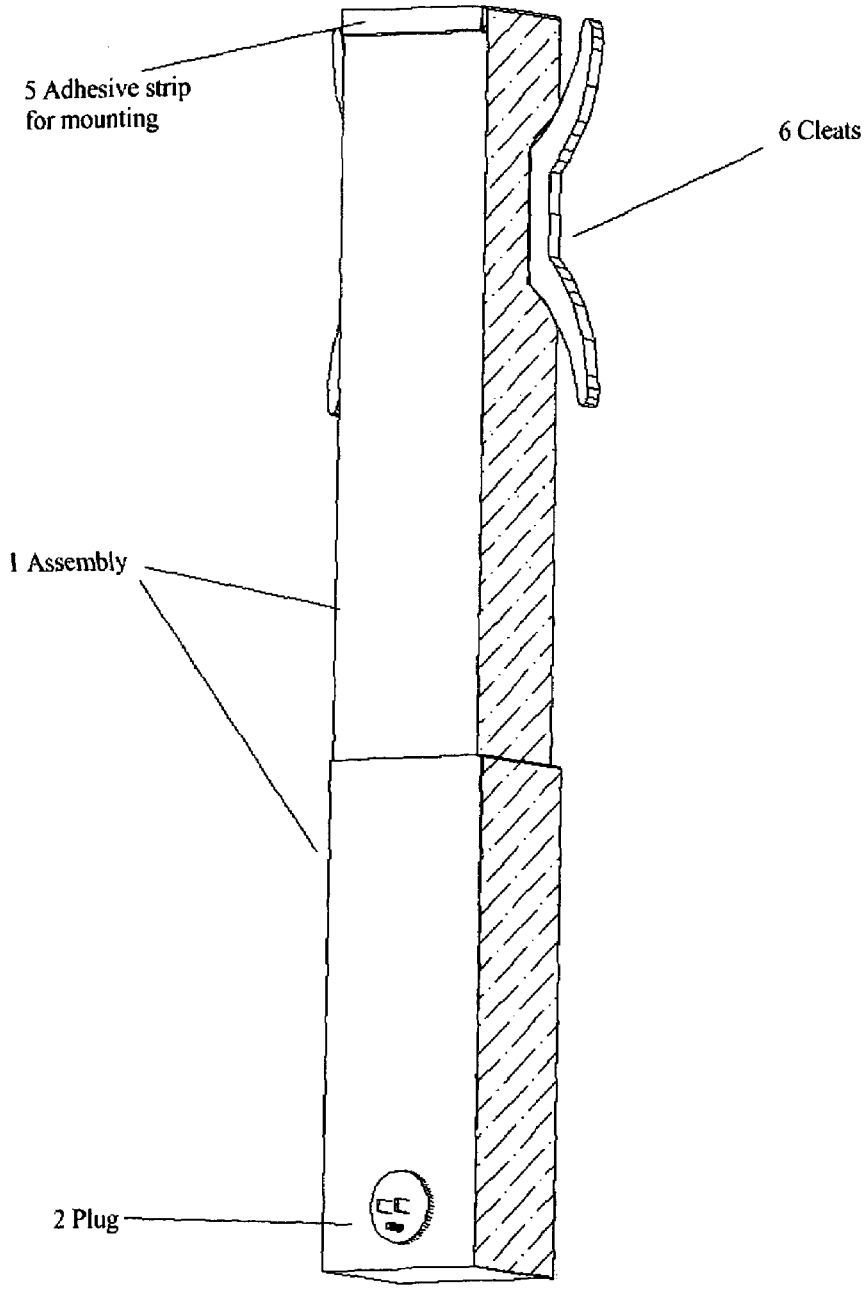

FIG 2 Showing Room Side of Device.
A vertical extender for an electrical outlet which protects pets and children from shock hazards
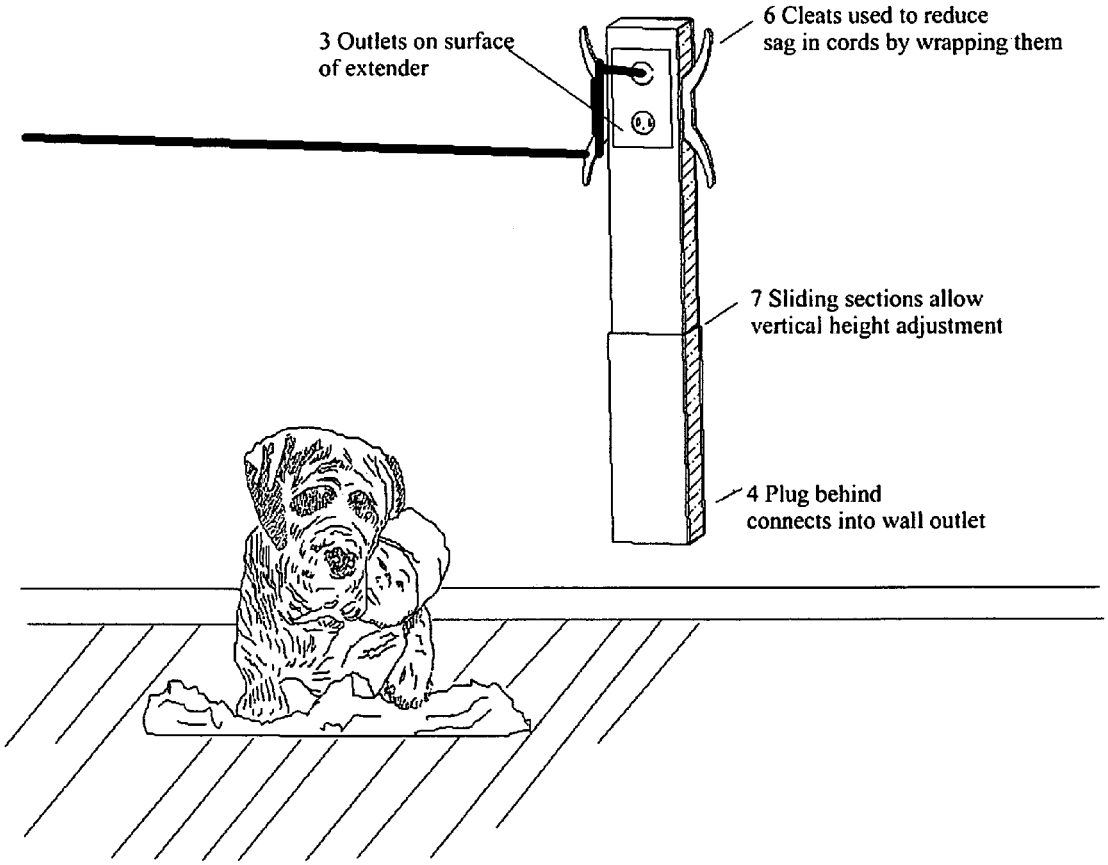

VERTICAL EXTENDER FOR AN ELECTRICAL OUTLET WHICH PROTECTS PETS AND CHILDREN FROM SHOCK HAZARDS

BACKGROUND

1. Field of the Invention

The present invention relates generally to a system for protecting electric cords and electric outlets from curious pets and children. More specifically, the present invention relates to a vertically oriented assembly which plugs into and covers the face of an existing electric outlet, substituting at least one outlet of its own which can be positioned higher and out of the reach of pets and children. The invention blocks access to any exposed current carrying elements in the existing wall outlet into which it is plugged. Said invention can be mounted against a wall or other surface.

2. Description of the Prior Art

Pets and very young children are subject to electric shocks or burns when they come into contact with charged elements in electric outlets or if they bite into or otherwise penetrate the insulation covering electric cords. Electric cords thus penetrated also constitute a potential fire hazard.

Many solutions have been offered to protect against danger from electric outlets and electric cords. For example U.S. Pat. No. 4,993,963, issued on Feb. 19, 1991 to William S Pedigo., titled "Protective outlet cover," describes a hinged protective cover for electric outlets; U.S. Pat. No. 7,078,624, issued on Jul. 19, 2006 to Darren Stewart, titled "Electrical Safety Power Cord," describes a power cord which, when paired with a specialized replacement outlet cover, clamps into place and can only be removed when two buttons on the power cord assembly are depressed; and U.S. Pat. No. 4,613,728 issued on Mar. 21, 1985 to Deborah A Lathrop, describes an enclosure box for electric outlets with hangers designed to secure electric cords and keep and reduce their slack. These and other methods of minimizing the risks associated with electric cords and electric outlets may have saved lives and prevented painful injuries. But when an electric device is plugged into an outlet, the cord, itself, presents a danger as it can be penetrated by the teeth of pets or by children. According to the US Product Safety Commission, about 4000 injuries associated with electric cords are treated in hospital emergency rooms each year. Thirteen percent of the injuries involve children less than five years of age. Electrical burns to the mouth account for half of the injuries to young children. The commission also estimates that about 3300 residential fires originate in extension cords each year, killing 40 people and injuring about 270 others.

Certain sprays may discourage biting into cords. A plastic sheath, called CritterCord (D&W Innovations, LLC, Elm Crove, Wis.), which is apparently also available as CordProtector through PetsMart, Inc. (Phoenix, Ariz.), is infused with a citric scent. Electric cords can also be protected by enclosing them with commercially available braided metal sheaths, wire mold or conduit. Each of these solutions provides a level of protection. But enclosing each electric cord in a sheath is expensive and time-consuming and scented repellants are unreliable and may require frequent reapplication. Since, no chemical repellant is universally effective, it is difficult to predict the benefit in a particular setting. Moreover, some of these methods leave the portion of the cord near the plug exposed as well as the plug itself, providing a tempting target for curious pets and youngsters.

None of the above inventions and patents, taken either singly or in combination, is seen to describe the instant invention as claimed.

This invention greatly reduces the effort required to provide temporary electrical safety for small pets and children. It is plugged into the existing outlet and mounted against a surface using a convenient mounting technique such as a self-adhering adhesive. All outlets in a designated area can be thus protected and electrical devices connected to them, with cord slack taken up, are also beyond harm.

SUMMARY OF THE INVENTION

In accordance with the present invention, an electrical outlet adapter is described comprising a plug end with at least one electrical plug, an extension section with no exposed electrical cords and which extension section can be mounted against a wall surface, and a socket end with least one electrical socket mounted some distance beyond the plug end such that, when said outlet adapter is deployed vertically, its socket end is beyond the reach of children and small pets. Additionally, a means is provided to wrap, retract, or otherwise reduce the slack in connected electric cords to prevent them from sagging and being chewed or otherwise penetrated.

Objects and Advantages

It is a principal of this invention to elevate electric cords above the level at which they can be penetrated by small pets and young children. Accordingly, several objects and advantages of the present inventions are:

(a) It is an object of this invention to provide a receptacle for electric cords that is high enough to protect them from small pets and small children.

(b) It is a further object of this invention to prevent said electric cords from sagging and hence becoming vulnerable to said small pets or said small children.

(c) It is a further object of this invention to conceal and protect electrified surfaces of existing wall outlets into which this invention is connected from said small pets and small children.

BRIEF DESCRIPTION OF THE INVENTION

A vertical extender is described for an electric outlet. The vertical extender has an electric plug which can be inserted into an existing wall outlet in a manner that covers and protects the electrified parts of that existing wall outlet. The vertical extender has provision for being mounted against a surface such as a wall and has at least one electric outlet of its own mounted at a level which is beyond the reach of small pets and children. A means is also provided to wrap, retract, or otherwise reduce the slack in connected electric cords to prevent them from sagging. With the outlet and, optionally, all portions of connected electric cords, at a level above the reach of small children and pets, electrical dangers are diminished.

BRIEF DESCRIPTION OF THE DRAWINGS

FIGS. 1 and 2 depict an exemplary device for implementing the present invention.

DETAILED DESCRIPTION OF THE PREFERRED EMBODIMENT

A vertically oriented assembly (1 in FIG. 1) elevates the point of connection with all connected devices to a safe height. While the vertically oriented assembly in this exemplary system is fixed in length and has a rigid electric plug (2 in FIG. 1), other arrangements are possible. For example, said assembly's length could be adjusted using a sliding mechanism, extension modules, or other techniques. Said plug, which, in this embodiment, is incorporated into the housing of the invention, could, in other embodiments, be rotatable or connected flexibly to accommodate to the orientation of existing wall outlets. Said plug can be inserted into an existing wall outlet, substituting at least one electric outlet of its own (3 in FIG. 2) which electric outlet is located higher and out of the reach of pets and children. This invention also physically blocks access to any exposed current carrying elements in the electric outlet to which it is connected (4 in FIG. 2). Said invention can be mounted against a wall or other surface using, in this example, an included adhesive strip (5 in FIG. 1). Other fastening techniques include other types of adhesives, hardware fasteners such as screws, bolts, tacks, and the like.

Side-mounted cleats (6 in FIG. 1), in this example, remove the slack from connected electric cords. Although cleats are used in this example, other means could be used to remove cord slack such as, but not limited to, a storage chamber with a cord grip or a spring loaded retractor.

We claim:

1. An electrical outlet extension adapter comprising a. a vertical extension section that has no exposed electrical cords, and b. at least one electrical plug suitable for connection to an electrical wall outlet, mounted at the lowest end of this vertical extension section, and c. at least one electrical socket mounted near the top of the vertical extension section such that the socket end is placed some vertical distance, at least 2 feet, away from the electrical plug end, and d. a means to wrap the extra length of an attached appliance's electrical cord so that the attached electrical cord will not sag below a safe height above the floor, which is about 1 foot or more beyond the reach of pets and children, and e. where the vertical extension section is adjustable in length, from the minimum of 2 feet to a maximum of about 4 feet, so that a safe height above the floor for the cords of attached appliances can be established, taking into account the sizes and reach of protected pets and children.

2. an electrical outlet extension adapter comprising a. at least one electrical plug suitable for connection to an electrical wall outlet, and b. an enclosed extension section that has no exposed electrical cords, c. a socket end with at least one electrical socket mounted a vertical distance away from the plug end, and d. a means to wrap the extra length of an attached electrical cord so that it will not sag below a sate height above the floor, beyond the reach of a child or a pet, such as a dog or cat.

3. the electrical outlet extension adapter of claim 2, where a cleat is used to provide the means to wrap the extra length of an attached electrical cord.

4. an electrical outlet extension adapter comprising a. at least one electrical plug suitable for connection to an electrical wall outlet, and b. an enclosed extension section that has no exposed electrical cords, that is mounted vertically, and that covers the wall outlet completely when the electrical plug is connected to the wall outlet, c. the enclosed extension section has a socket end, located opposite the plug end, with at least one electrical socket thus mounted some vertical distance away from the plug end, d. near the socket end is located a means to wrap the extra length of an attached electrical cord, so that when this cord is plugged into the socket or the enclosed extension, the attached cord will not sag below a safe height above the floor such that the cord remains beyond the reach of pets and children.

* * * * *